US009635996B2

(12) United States Patent
Alwin

(10) Patent No.: US 9,635,996 B2
(45) Date of Patent: May 2, 2017

(54) MODULAR CUTLERY BASKET

(71) Applicant: Electrolux Appliances Aktiebolag, Stockholm (SE)

(72) Inventor: Peter Alwin, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/783,647

(22) PCT Filed: Jun. 26, 2013

(86) PCT No.: PCT/EP2013/063380

§ 371 (c)(1),
(2) Date: Oct. 9, 2015

(87) PCT Pub. No.: WO2014/206458

PCT Pub. Date: Dec. 31, 2014

(65) Prior Publication Data

US 2016/0088997 A1 Mar. 31, 2016

(51) Int. Cl.

| | |
|---|---|
| ***A47L 15/50*** | (2006.01) |
| ***B65D 25/04*** | (2006.01) |
| ***B65D 25/28*** | (2006.01) |

(52) U.S. Cl.

CPC ..... *A47L 15/502* (2013.01); *B65D 25/04* (2013.01); *B65D 25/2826* (2013.01)

(58) Field of Classification Search

CPC .... B65D 25/06; B65D 25/04; B65D 25/2826; B65D 25/2802; B65D 25/28; B65D 25/32; A47L 15/503; A47L 15/502; A47L 15/50; A47L 15/505; A47F 5/083; A47B 87/005; A47B 87/007; A47B 87/008

USPC ..... 220/488, 487, 486, 23.4, 23.2, 23.83, 220/507, 760, 759, 752, 756, 757, 23.86, 220/676; 211/201, 195, 41.3, 41.4, 41.5, (Continued)

(56) References Cited

U.S. PATENT DOCUMENTS

| | | | |
|---|---|---|---|
| 3,759,596 | A | 9/1973 | Bergmeyer et al. |
| 5,101,969 | A | 4/1992 | Umiker |
| 5,431,294 | A | 7/1995 | Stottmann et al. |

(Continued)

FOREIGN PATENT DOCUMENTS

| | | | |
|---|---|---|---|
| DE | 79 23 328 | U1 | 11/1979 |
| EP | 0 389 802 | A1 | 10/1990 |

(Continued)

OTHER PUBLICATIONS

BOSCH Dishwasher 9000433250 Manual, (dated Rev Jul. 2009) 80 pages.

(Continued)

*Primary Examiner* — Robert J Hicks
(74) *Attorney, Agent, or Firm* — Alston & Bird LLP

(57) ABSTRACT

The invention relates to a cutlery basket having a first basket component and a second basket component and a handle, wherein the first and second basket components are adapted to be arranged in a serial and a parallel configuration, wherein one or more components may be provided for locking the first and second basket components in a serial and a parallel configuration and the one or more components for locking the basket components in a serial and parallel configuration may be formed by or include the handle.

15 Claims, 6 Drawing Sheets

(58) Field of Classification Search
USPC .. 211/41.6, 41.8, 41.2, 41.1, 41.9, 188, 194; 206/745, 553
See application file for complete search history.

(56) References Cited

U.S. PATENT DOCUMENTS

| | | | | |
|---|---|---|---|---|
| D487,825 | S * | 3/2004 | Kim | D32/3 |
| 7,073,682 | B2 * | 7/2006 | Raches | A47L 15/502 220/488 |
| 2006/0237053 | A1 * | 10/2006 | Bengston | A47L 15/502 134/58 D |

FOREIGN PATENT DOCUMENTS

| | | | |
|---|---|---|---|
| EP | 0 697 187 | A1 | 2/1996 |
| JP | S52 4275 | U | 1/1977 |
| KR | 2007 0066360 | A | 6/2007 |
| WO | WO 2004/000090 | A1 | 12/2003 |

OTHER PUBLICATIONS

Images of Bosch DW Interiors [online] [retrieved Oct. 8, 2015]. Retrieved from the Internet: <URL: http://ths.gardenweb.com/discussions/2285051/images-of-bosch-dw-interiors>. (dated May 13, 2012) 14 pages.
International Search Report for Application No. PCT/EP2013/063380 dated Mar. 24, 2014.

* cited by examiner

MODULAR CUTLERY BASKET

CROSS-REFERENCE TO RELATED APPLICATIONS

This application is a national stage application filed under 35 U.S.C. §371 of International Application No. PCT/EP2013/063380 filed Jun. 26, 2013, which application is hereby incorporated by reference in its entirety.

FIELD OF THE INVENTION

The present invention relates generally to the field of cutlery baskets for dishwashers. More specifically, the present invention is related to a modular cutlery basket adapted to be arranged in a parallel and a serial configuration.

BACKGROUND OF THE INVENTION

Cutlery baskets are used in dishwashers to hold smaller items, e.g. cutlery in order to ensure effective cleaning of said items during washing operation. Typically, said cutlery baskets are formed lattice-like and comprise a plurality of compartments for receiving and holding said items in a vertical direction.

Depending on the country, in which a dishwasher is employed, cutlery baskets have different forms. For example, in the European market cutlery baskets are used, which comprise a rectangular base area, wherein the longitudinal side takes about the half of depth of the interior space of the dishwasher. In contrary thereto, the North American market prefers elongated cutlery baskets, which fit to the depth of the interior space of the dishwasher.

Korean patent application KR 20070066360 A discloses cutlery basket comprising two basket components, which are connected by a hinge portion. Thereby, it is possible to pivot one basket component with respect to the other basket component in order to arrange the cutlery basket in parallel configuration or in serial configuration.

A drawback of the known cutlery basket is that the cutlery basket consists of two different basket components, so, different tools for manufacturing said basket components are necessary. A further drawback of the known cutlery basket is the lack of a grip portion in the middle of the cutlery basket, if it is arranged in serial configuration. Thereby the handling of the cutlery basket is difficult. Finally, the arrangement of the cutlery basket in the respective configuration is laborious. Accordingly, there is a need for improvements regarding the manufacturing and handling of known cutlery baskets.

SUMMARY OF THE INVENTION

It is an objective of embodiments of the invention to provide for an improved cutlery basket which is easy to produce and to handle. The objective is solved by the features of the independent claims. Preferred embodiments are given in the dependent claims. If not explicitly indicated otherwise, embodiments of the invention can be freely combined with each other.

According to a first aspect of the invention, the invention relates to a cutlery basket comprising a first basket component and a second basket component and a handle, wherein the first and second basket components are adapted to be arranged in a serial and a parallel configuration and wherein means are provided for locking the first and second basket components in a serial and a parallel configuration. The means for locking the basket components in a serial and parallel configuration are formed by the handle. Using the handle as an interlocking mean, the handling of the cutlery basket is simplified and additional interlocking means can be avoided.

According to preferred embodiments, the first and second basket components are formed identically. Hence, both basket components can be manufactured using the same tooling. Preferably the basket components are injection moulded parts made of plastic, so both basket components may be produced using the same injection mould.

According to preferred embodiments, the handle comprises a grip portion and at least two columns protruding at the bottom side of the gripping portion. The columns may comprise means for interlocking the first and second basket components thereby forming the cutlery basket.

According to preferred embodiments, the first and second basket component comprises at least one recess for receiving a portion of the handle. Said recess may be formed within the basket component. Furthermore the recess may be integrally formed within the basket components and may be form-fitted to the columns of the handle. Hereby a partly insertion of the handle into the basket components is possible.

According to preferred embodiments, the first and second basket component comprises at least one recess for receiving at least a free end portion of the columns of the handle. Thereby it is possible to insert said free end portions of the handle into the basket components in order to interconnect said basket components thereby forming the cutlery basket. Preferably, the handle is adapted to be inserted from the top into the recess formed within the first and the second basket components.

According to preferred embodiments, the handle may be adapted to be inserted in a first direction, in which the longitudinal direction of the basket components is parallel to the gripping portion for connecting the basket components in the serial configuration and a second direction, in which the longitudinal direction of the basket components is perpendicular to the gripping portion for connecting the basket components in the parallel configuration. By inserting the handle in different directions it is possible to utilise the clamping functionality of the U-shaped or C-shaped handle in both configurations.

According to preferred embodiments, the columns of the handle are adapted to snap into the bottom of the first and second basket components. The basket components or the handle may comprise snap-fits for engaging with the handle, respectively, the bottom of the basket components. Thereby the handle is secured against loosening from the basket components.

According to preferred embodiments, the handle is adapted to clamp the first and second basket components against each other.

The basket components may abut at the longitudinal side portions or the narrow side portions depending on which configuration of the cutlery basket is required. The handle may at least partly extend over the basket components and transfer clamping forces onto said basket components for interconnection. In addition, the basket components may comprise further means for interlocking with each other.

According to preferred embodiments, the handle comprises snap-fits for connecting the first and second basket component.

Thereby it is possible to interconnect the basket components via the handle.

According to preferred embodiments, the handle comprises two pairs of snap-fits at opposite sides of the columns of the handle. Preferably the snap-fits are located at the longitudinal sides of the handle. Thereby it is possible to attach the first basket component at the first longitudinal side of the handle and the second basket component at the opposite side.

According to preferred embodiments, the handle is adapted to laterally snap around outer side portions of the basket components for connecting the first and second basket components in the parallel configuration. Said outer side portions may be formed by a pair of vertical bars located at the edges of the basket components. One bar may be part of the first basket component and the further bar may be part of the second basket component. The handle may comprise clips adapted to grip said pair of bars for interconnecting the basket components.

According to preferred embodiments, the basket components comprise at least one aperture at the top of the basket component for inserting the free ends of the columns of the handle and a fastening portion located inside the basket components for snapping the handle to the basket components in the serial configuration. Said fastening portion may be formed by a partition wall comprising slots adapted to the clips of the handle. Thereby the clips of the handle may snap into the slots of the partition wall in order to clamp the basket components at the narrow side portions against each other.

According to a second aspect of the invention, the invention relates to a dish washer with a cutlery basket according to the previously described embodiments.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
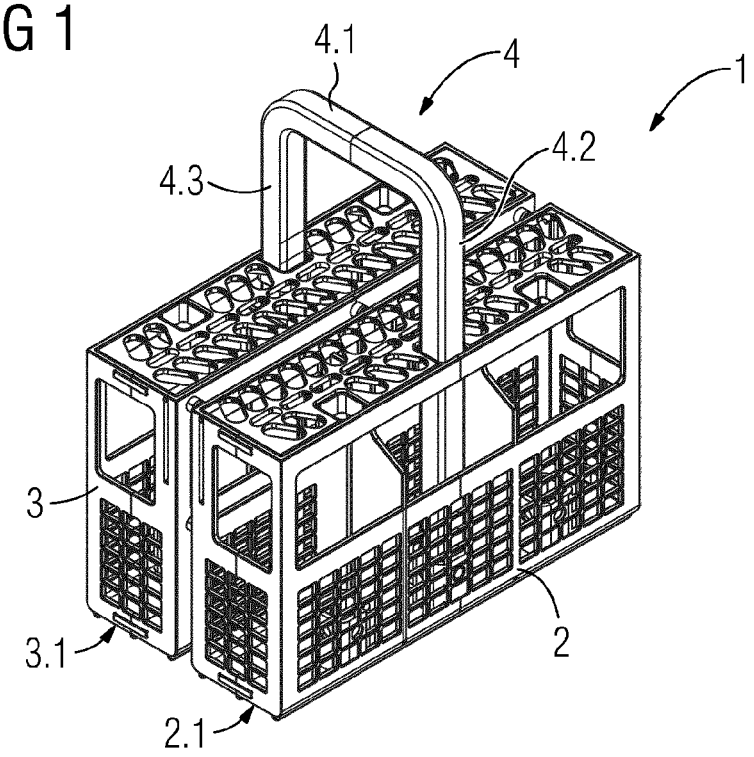
FIG. 1 shows a cutlery basket in parallel configuration according to a first embodiment of the invention.
Figure 2:
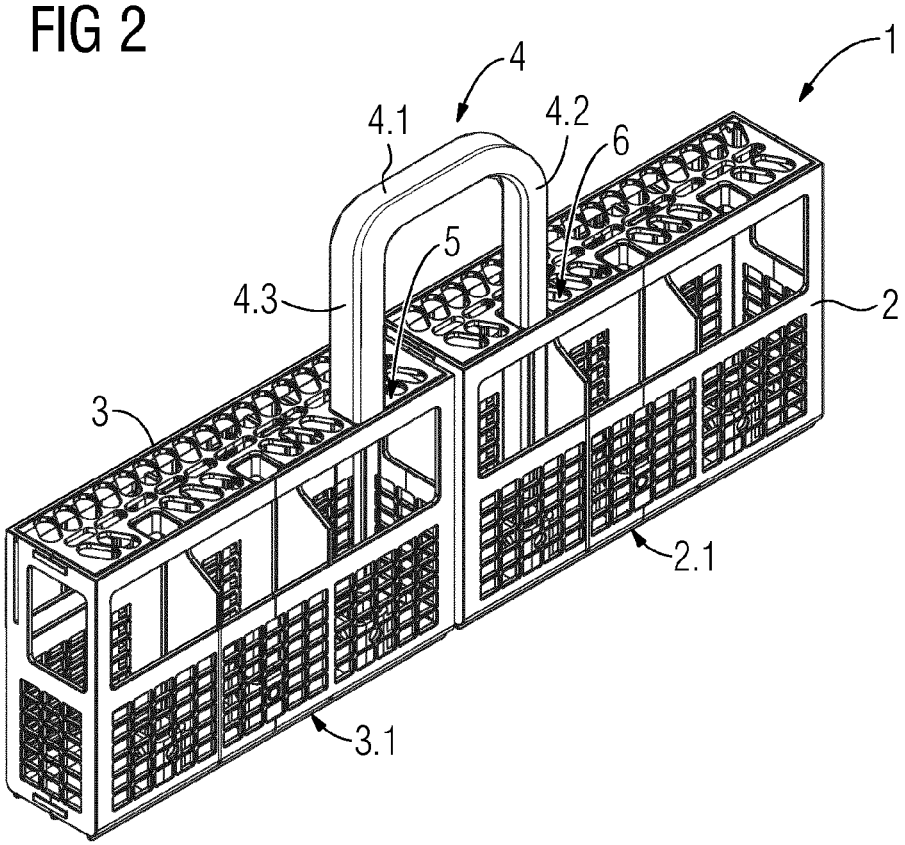
FIG. 2 shows a cutlery basket in serial configuration according to the first embodiment of the invention.
Figure 3:
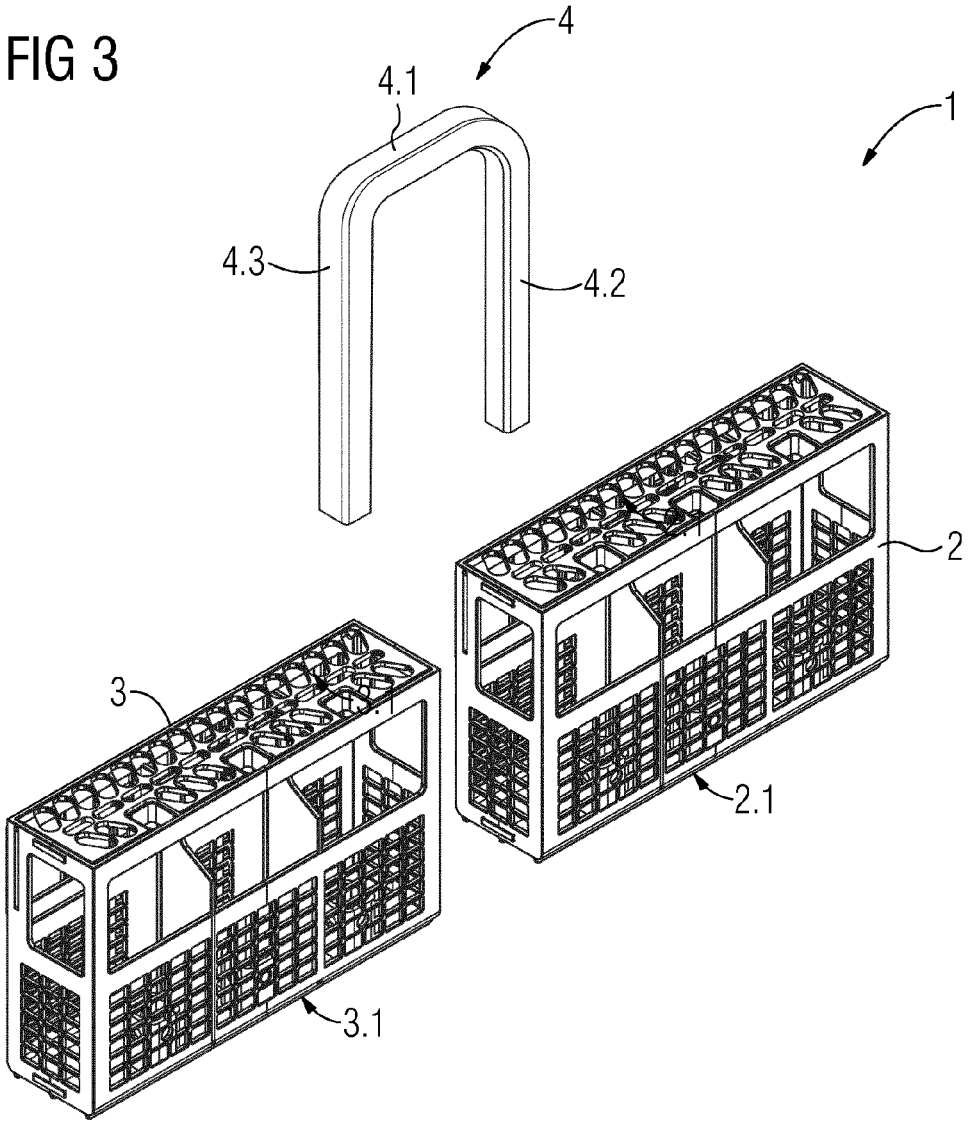
FIG. 3 shows a cutlery basket according to the first embodiment of the invention in an exploded view.
Figure 4:
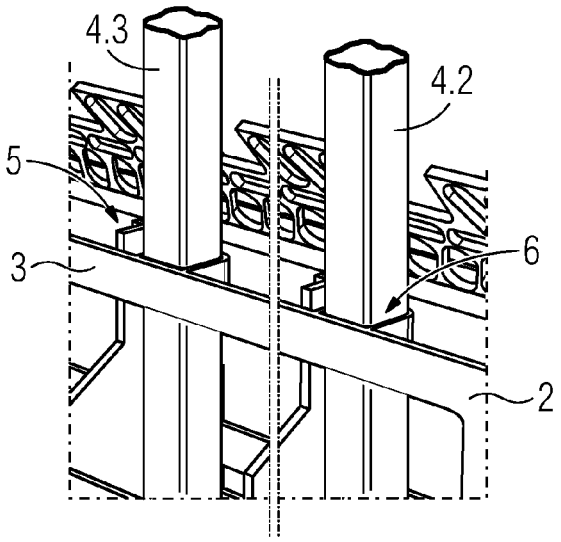
FIG. 4 shows in detail the handle insertion area of the cutlery basket of FIG. 2.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIGS. 1-4 illustrate a modular cutlery basket 1 according to a first embodiment of the invention. The cutlery basket 1 comprises a first basket component 2, a second basket component 3 and handle 4, which protrudes on the top of the cutlery basket in order to provide a grip portion. The basket components 2, 3 are formed identically, i.e. they are produced by means of the same tool, for example an injection mold tool. Each basket component 2, 3 may comprise a cuboid-shaped form with a rectangular base. Furthermore, the basket components 2, 3 may comprise a lattice-like structure with a plurality of compartments for receiving and holding items, e.g. cutlery.

The cutlery basket 1 is adapted to be configured in parallel configuration, in which the longitudinal sides of the basket components 2, 3 are arranged next to each other, and serial configuration, in which the narrow sides of the basket components 2, 3 are facing each other.

The handle 4 removable from the cutlery basket 1 is adapted to lock the basket components 2, 3 against each other and thereby maintain the serial, respectively, the parallel configuration. For that purpose, the handle 4 comprises a grip portion 4.1 and two columns 4.2, 4.3, which protrude at the bottom side of the grip portion 4.1. Each column 4.2, 4.3 comprise a free end located at a distance to the grip portion 4.1, wherein the free ends of the columns 4.2, 4.3 may adapted to be inserted into the basket components 2, 3.

The basket components 2, 3 comprise means for receiving the free ends of the columns 4.2, 4.3. Said means for receiving the free ends are formed by recesses 5, 6, which are adapted for receiving said free ends of the columns 4.2, 4.3. Preferably, said recesses 5, 6 are form-fitted to the cross-sections of the free ends of the columns 4.2, 4.3. Said recesses 5, 6 may be formed by webs integrally formed within the bodies of the basket components 2, 3. Thereby the handle 4 is adapted to be introduced into said the basket components 2, 3 in order to hold the basket components 2, 3 together. Preferably, the free ends of the columns 4.2, 4.3 are inserted into the basket components 2, 3 until the free ends of the columns 4.2, 4.3 are in contact with the bottom 2.1, 3.1 of the basket components 2, 3. At the bottom 2.1, 3.1, there may be snap-fits for locking the free ends of the columns 4.2, 4.3 with the basket components 2, 3.

In a preferred embodiment, the basket components 2, 3 provide different recesses 5, 6 for receiving the free ends of the columns 4.2, 4.3 of the handle 4 in the parallel configuration and the serial configuration. Thereby it is possible to obtain an optimal position for the handle 4 in both configurations. Preferably, a first recess may be provided close to a narrow side of the basket components 2, 3 in order to receive a column 4.2, 4.3 of the handle 4 in the serial configuration of the cutlery basket 1. The further recess is provided centered between the narrow sides of the basket components 2, 3 in order to receive a column 4.2, 4.3 of the handle 4 in the parallel configuration of the cutlery basket 1. Thereby, the handle 4 extends across the abutting narrow sides of the basket components 2, 3 in the serial configuration and across the abutting longitudinal sides of the basket components 2, 3 in the parallel configuration of the cutlery basket 1. As a result, the handle 4 is centrally arranged in the serial configuration as well as the parallel configuration.

FIGS. 5-8 show a modular cutlery basket 1 according to a second embodiment of the invention. Similarly to the cutlery basket 1 of the first embodiment, the cutlery basket 1 comprises a first basket component 2, a second basket component 3 and handle 4, which protrudes on the top of the cutlery basket 1 in order to provide a grip portion. The basket components 2, 3 of the second embodiment are formed identically, i.e. they are produced by means of the same tool, for example an injection mold tool. Each basket component 2, 3 comprise a cuboid shape with a rectangular base. Furthermore, the basket components 2, 3 comprise a lattice-like structure with a plurality of compartments for receiving and holding items, e.g. cutlery.

The cutlery basket 1 of the second embodiment is also adapted to be configured in parallel configuration, in which the longitudinal sides of the basket components 2, 3 are arranged next to each other, and a serial configuration, in which the narrow sides of the basket components 2, 3 are facing each other.

The handle 4 removable from the cutlery basket 1 is adapted to lock the basket components 2, 3 against each other and thereby maintain the serial, respectively, the parallel configuration. For that purpose, the handle 4 comprises hook-shaped snap-fits 4.4. Said snap-fits 4.4 may preferably be located at the lateral surfaces aligned parallel to the longitudinal direction of the grip portion 4.1 of the handle 1. The snap-fits 4.4 provide receptacles for side portions of the basket components 2, 3. Said side portions may be bar-shaped portions at the longitudinal sides of the basket components 2, 3. For joining the basket components 2, 3, the side portions may be inserted into the receptacles. The snap-fits 4.4 may be adapted to engage behind the upper side of the side portions to avoid an undesirable self-loosening.

For locking the basket components 2, 3, the handle 4 may comprise two pairs of snap-fits 4.4 at opposite sides, namely two snap-fits 4.4 at opposite sides of the columns 4.2, 4.3. Thereby it is possible to lock two basket components 2, 3 in series at one side of the handle 4 or to lock one basket component 2, 3 per each side of the handle 4 in order to obtain the parallel configuration.

Figure 5:
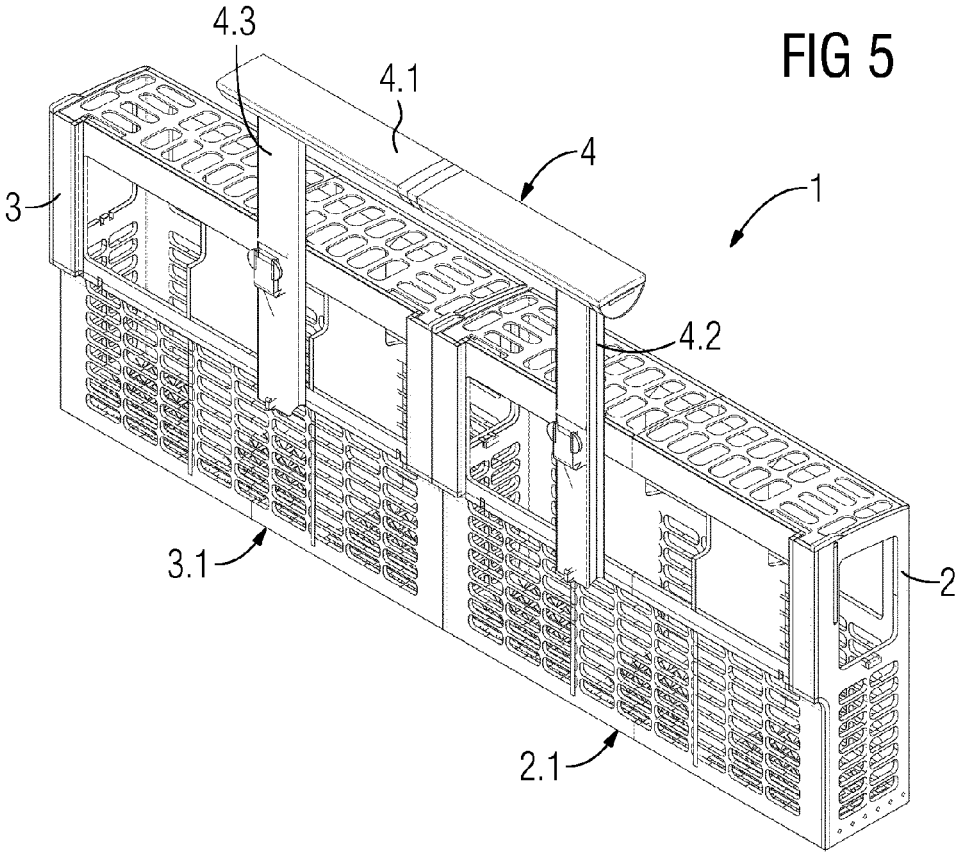
FIG. 5 shows a cutlery basket in serial configuration according to a second embodiment of the invention.
Figure 6:
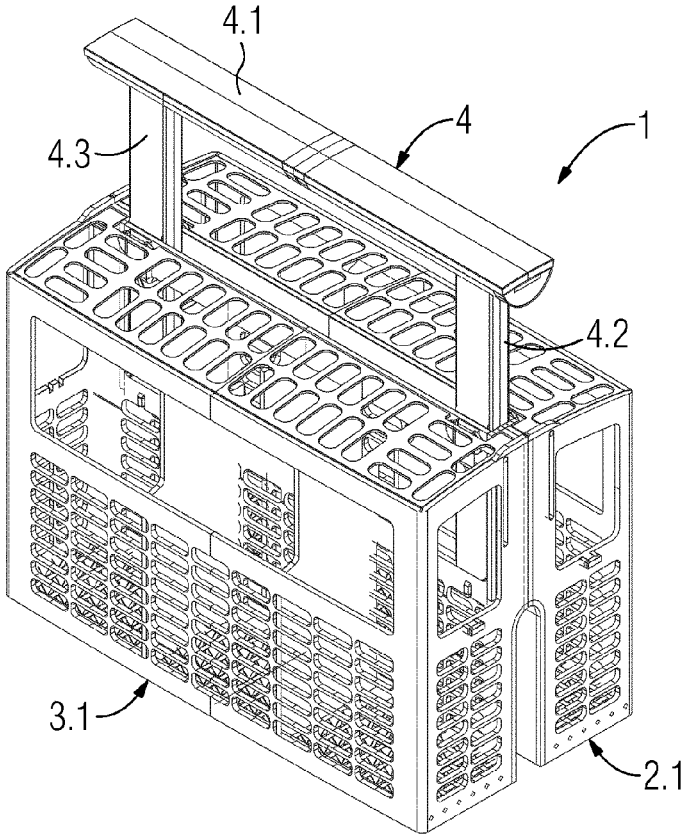
FIG. 6 shows a cutlery basket in parallel configuration according to the second embodiment of the invention.
Figure 7:
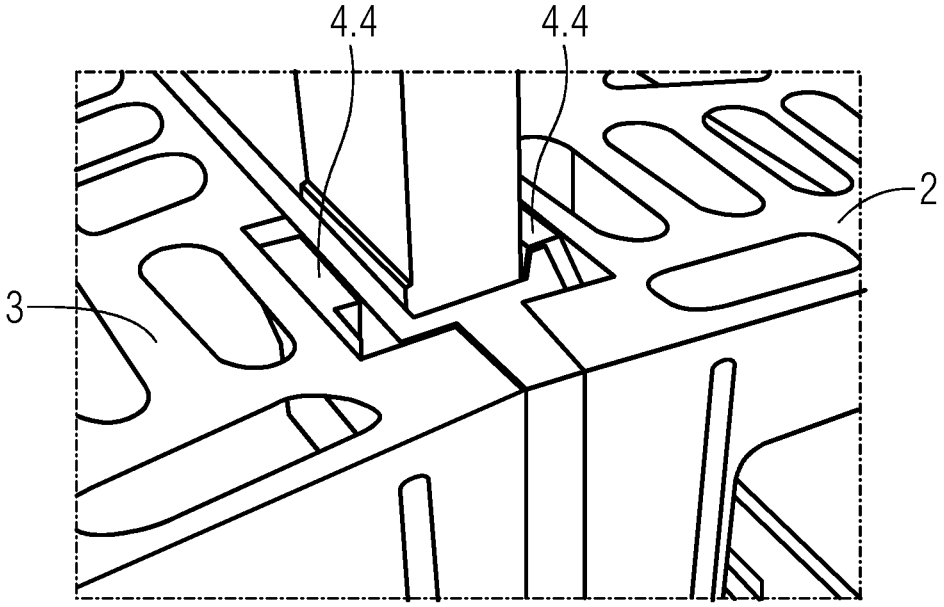
FIG. 7 shows in detail the snap-fit area of the cutlery basket of FIG. 6.
Figure 8:
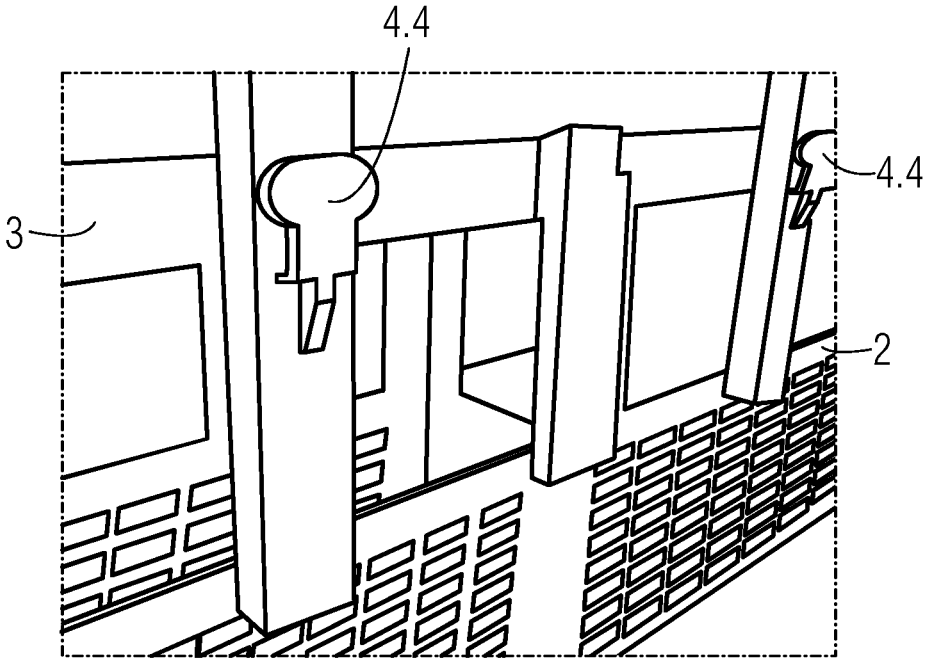
FIG. 8 shows in detail the snap-fit area of the cutlery basket of FIG. 5.

As can be seen in FIGS. 5 and 6, the handle 4 may be connected with the basket components 2, 3 at different positions. In parallel configuration, the handle 4 is located centrically with respect to the longitudinal side of the basket components 2, 3 in between said basket components 2, 3. Thereby, both columns 4.2, 4.3 are locked by snap-fits 4.4 with both basket components 2, 3.

In serial configuration, the handle 4 is arranged off-centred with respect to each basket component 2, 3, but the handle 4 is located centrically with respect to the serial arrangement of the basket components 2, 3, wherein both basket components 2, 3 are arranged at the same side of the handle 4. Thereby, in each case (serial and parallel configuration) the handle 4 is positioned centrically with respect to the longitudinal direction of the cutlery basket 1.

Figure 9:
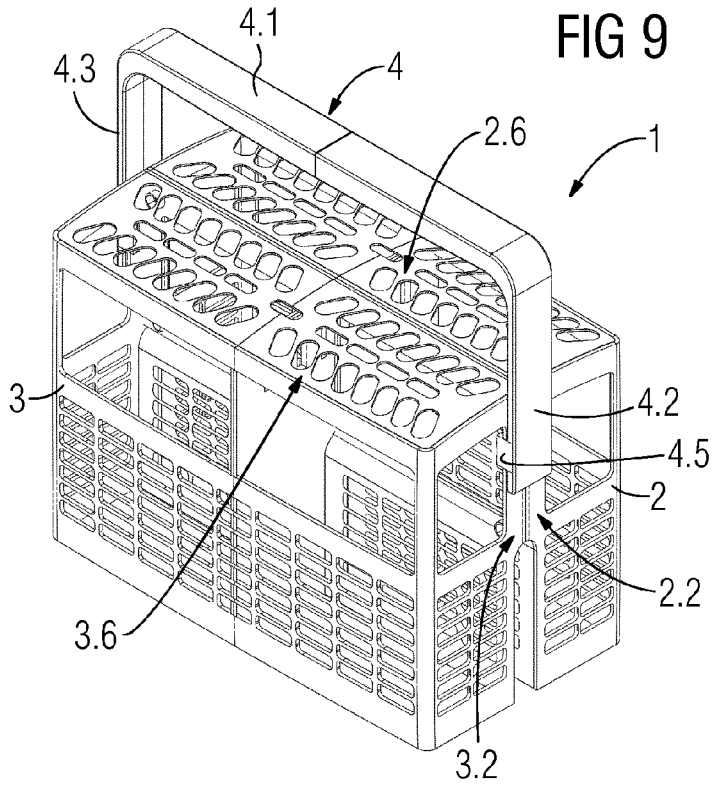
FIG. 9 shows a cutlery basket in parallel configuration according to a third embodiment of the invention.
Figure 10:
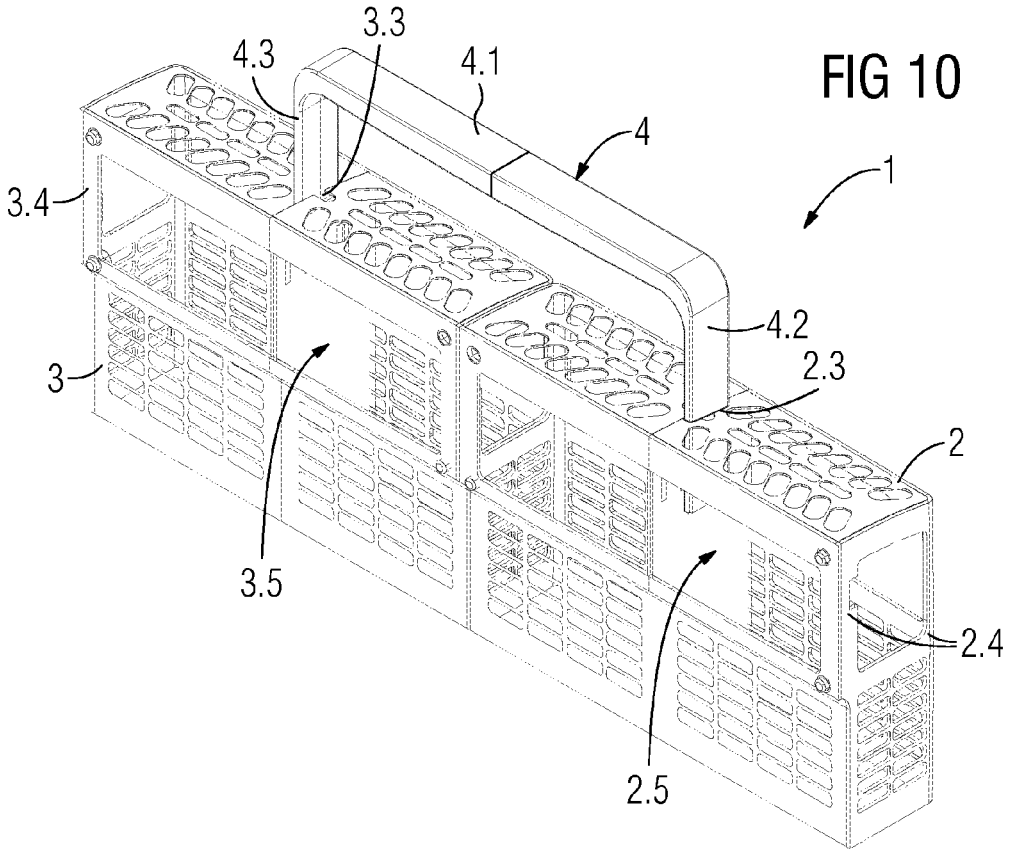
FIG. 10 shows a cutlery basket in serial configuration according to a third embodiment of the invention.
Figure 11:
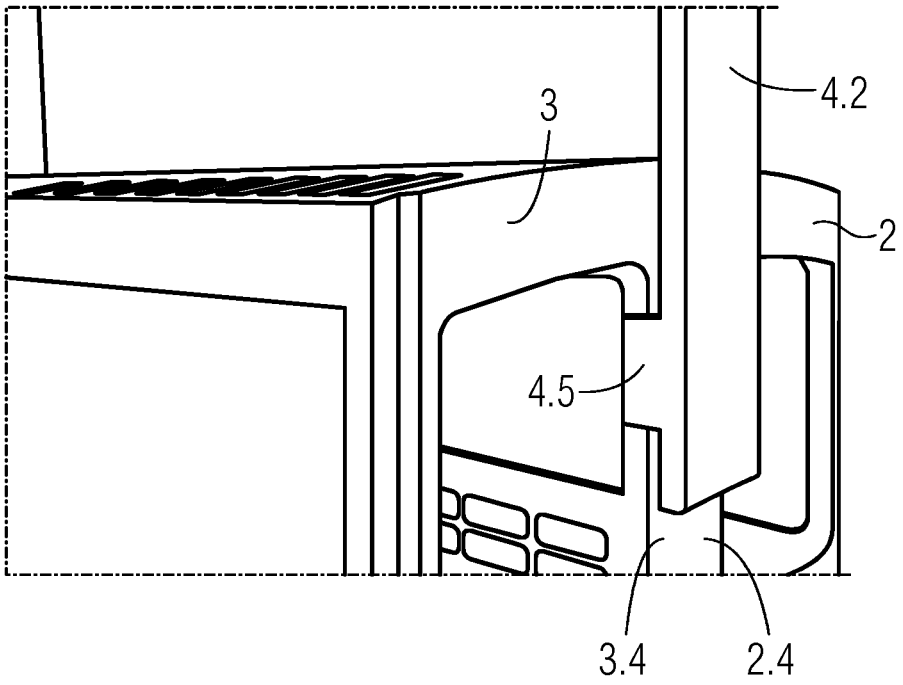
FIG. 11 shows a detailed view of the snapping area of the handle according to FIG. 9.

FIGS. 9-11 show a modular cutlery basket 1 according to a third embodiment of the invention. Similarly to the cutlery basket 1 of the first and second embodiment, the cutlery basket 1 comprises a first basket component 2, a second basket component 3 and handle 4, which protrudes on the top of the cutlery basket 1 in order to provide a grip portion. The basket components 2, 3 of the third embodiment are formed identically, i.e. they are produced by means of the same tool, for example an injection mold tool. Each basket component 2, 3 comprise a cuboid shape with a rectangular base. Furthermore, the basket components 2, 3 comprise a lattice-like structure with a plurality of compartments for receiving and holding items, e.g. cutlery.

The cutlery basket 1 of the third embodiment is also adapted to be configured in parallel configuration, in which the longitudinal sides of the basket components 2, 3 are arranged next to each other, and a serial configuration, in which the narrow sides of the basket components 2, 3 are facing each other.

The handle 4 removable from the cutlery basket 1 is adapted to lock the basket components 2, 3 against each other and thereby maintain the serial, respectively, the parallel configuration. For that purpose, each column 4.2, 4.3 of the handle 4 comprise tongs-like clips 4.5 in proximity of the free ends. The clips 4.5 are located at the inner sides of the columns 4.2, 4.3 and face each other.

In parallel configuration, handle 4 laterally snap around outer side portions 2.2, 3.2 of the basket components 2, 3 for connecting the first and second basket components 2, 3 in the parallel configuration. The handle 4 clasps the basket components 2, 3, i.e. the free ends of the columns 4.2, 4.3 of the handle 4 are located at the narrow sides of the basket components 2, 3. Preferably, the basket components 2, 3 comprise bars 3.4 at each corner, wherein in parallel configuration at each narrow side of the basket components 2, 3, one bar 3.4 of the first basket component 2 and one bar 3.4 of the opposite second basket component 3 abut against each other and form the outer side portion 2.2, 3.2 clasped by the clip 4.5. In other words, the clip 4.5 is adapted to partly grip around the outer side portions 2.2, 3.2 built by the bars 3.4 located in the respective corners of the basket components 2, 3.

For connecting the basket components 2, 3 in the serial configuration (FIG. 10), each basket component 2, 3 comprises an aperture 2.3, 3.3 at the top side adapted to receive the free ends of the columns 4.2, 4.3 of the handle 4. The basket components 2, 3 further comprise a partition wall 2.5, 3.5 preferably located in the centre of the basket components 2, 3 and parallel to the narrow sides of said basket components 2, 3. The apertures 2.3, 3.3 may be located in proximity to said partition walls 2.5, 3.5 between the partition walls 2.5, 3.5 and the outer narrow sides of the basket components 2, 3. Each partition wall 2.5, 3.5 further comprises a pair of vertically arranged slots 2.6, 3.6 which are adapted for receiving the clips 4.5 of the handle 4.

In order to interconnect the basket components 2, 3 in serial configuration, the free ends of the columns 4.2, 4.3 are inserted into the apertures 2.3, 3.3 such, that the clips 4.5 engage with the slots 2.6, 3.6. Thereby, the handle 4 applies lateral forces on the basket components 2, 3 thereby clamping the first and second basket components 2, 3 against each other at the inner narrow side portions.

LIST OF REFERENCE NUMERALS

1 cutlery basket
2 first basket component
2.1 bottom
2.2 outer side portion
2.3 aperture
2.4 bar
2.5 partition wall
2.6 slot
3 second basket component
3.1 bottom
3.2 outer side portion
3.3 aperture
3.4 bar
3.5 partition wall
3.6 slot

4 handle
4.1 grip portion
4.2 column
4.3 column
4.4 snap-fit
4.5 clip
5 recess
6 recess

The invention claimed is:

1. Cutlery basket comprising a first basket component and a second basket component and a handle, wherein the first and second basket components are adapted to be arranged in a serial configuration and a parallel configuration and wherein means are provided for locking the first and second basket components in the serial and parallel configurations, wherein the means for locking the basket components in the serial and parallel configurations are formed by the handle.

2. Cutlery basket according to claim 1, wherein the first and second basket components are formed identically.

3. Cutlery basket according to claim 1, wherein the handle comprises a grip portion and at least two columns protruding at a bottom side of the gripping portion.

4. Cutlery basket according to claim 1, wherein each of the first and second basket components comprises at least one recess for receiving a portion of the handle.

5. Cutlery basket according to claim 3, wherein each of the first and second basket components comprises at least one recess for receiving at least a free end portion of one of the columns of the handle.

6. Cutlery basket according to claim 1, wherein the handle is adapted to clamp the first and second basket components against each other.

7. Cutlery basket according to claim 1, wherein the handle comprises snap-fits for connecting the first and second basket components.

8. Cutlery basket according to claim 3, wherein the handle comprises two pairs of snap-fits at opposite sides of the columns of the handle for connecting the first and second basket components.

9. Cutlery basket according to claim 1, wherein the handle is adapted to be inserted from a top side of the first and second basket components into a recess formed within the first and the second basket components.

10. Cutlery basket according to claim 9, wherein the handle is adapted to be inserted in a first direction, in which the longitudinal direction of the basket components is parallel to the gripping portion for connecting the basket components in the serial configuration and a second direction, in which the longitudinal direction of the basket components is perpendicular to the gripping portion for connecting the basket components in the parallel configuration.

11. Cutlery basket according to claim 9, wherein the handle comprises a grip portion and at least two columns protruding at a bottom side of the gripping portion and wherein the columns of the handle are adapted to snap into the bottom of the first and second basket components.

12. Cutlery basket according to claim 1, wherein the handle is adapted to laterally snap around outer side portions of the basket components for connecting the first and second basket components in the parallel configuration.

13. Cutlery basket according to claim 12, wherein the handle comprises a grip portion and at least two columns protruding at a bottom side of the gripping portion and wherein the basket components comprise at least one aperture at the top of the basket component for inserting free ends of the columns of the handle and a fastening portion located inside the basket components for snapping the handle to the basket components in the serial configuration.

14. Cutlery basket according to claim 13, wherein the fastening portion is formed by a partition wall.

15. Dish washer with a cutlery basket, wherein the cutlery basket comprises a first basket component and a second basket component and a handle, wherein the first and second basket components are adapted to be arranged in a serial and a parallel configuration and wherein means are provided for locking the first and second basket components in the serial and parallel configurations, wherein the means for locking the first and second basket components in the serial and parallel configurations are formed by the handle.

* * * * *